US009968186B2

(12) United States Patent
Failing

(10) Patent No.: US 9,968,186 B2
(45) Date of Patent: May 15, 2018

(54) ADJUSTABLE KEYBOARD TRAY AND MOUSE PAD

(71) Applicant: John Failing, Swanton, MD (US)

(72) Inventor: John Failing, Swanton, MD (US)

( * ) Notice: Subject to any disclaimer, the term of this patent is extended or adjusted under 35 U.S.C. 154(b) by 0 days. days.

(21) Appl. No.: 15/235,347

(22) Filed: Aug. 12, 2016

(65) Prior Publication Data

US 2018/0042375 A1 Feb. 15, 2018

(51) Int. Cl.
*A47B 21/00* (2006.01)
*A47B 21/03* (2006.01)
*A47B 21/02* (2006.01)

(52) U.S. Cl.
CPC ..... *A47B 21/0314* (2013.01); *A47B 21/02* (2013.01); *A47B 2021/035* (2013.01); *A47B 2200/0095* (2013.01)

(58) Field of Classification Search
CPC ..... G06F 3/0395; A47B 2021/0321; A47B 2021/0335; A47B 21/0314; A47B 21/02
USPC ..... 312/223.3, 208.1, 194; 248/316.1, 248/231.71, 310, 316.8, 298.1, 227.2, 248/281.11, 286.1, 918; 108/50.01, 108/50.02, 97, 98, 6–10
See application file for complete search history.

(56) References Cited

U.S. PATENT DOCUMENTS 4,706,919 A 11/1987 Soberalski et al.
5,037,054 A 8/1991 McConnell
5,211,367 A 5/1993 Musculus
5,230,289 A * 7/1993 George ..... A47B 21/0314 108/10
5,636,822 A * 6/1997 Hendershot ..... G06F 3/0395 248/346.01
5,685,235 A * 11/1997 Allan ..... A47B 21/0314 108/1
D412,894 S 8/1999 Little et al.
6,027,090 A 2/2000 Liu
6,076,785 A 6/2000 Oddsen
6,079,676 A 6/2000 Hackett et al.
6,098,935 A 8/2000 Kaplan et al.
6,186,460 B1 * 2/2001 Lin ..... A47B 21/0314 248/278.1
6,279,859 B2 * 8/2001 West ..... A47B 21/0314 248/118
6,336,618 B1 1/2002 Barber
6,390,432 B1 5/2002 Vanderheide et al.
6,478,279 B1 11/2002 Barber
(Continued)

*Primary Examiner* — Janet M Wilkens

(57) ABSTRACT

An adjustable keyboard tray with an adjustable mouse pad is disclosed. A connection mechanism of the keyboard tray provides: vertical height adjustment of the keyboard tray relative to an object to which it is connected; horizontal translational adjustment of the keyboard tray relative to the object; swivel movement of the keyboard tray about a vertical axis; and adjustable typing angle of the keyboard tray relative to a horizontal axis. A connection mechanism of the mouse pad is configured to: permit the mouse pad to be connected to either side of the keyboard tray; provide for angular adjustment of the mouse pad relative to the keyboard tray; and provide for height adjustment of the mouse pad relative to the keyboard tray. In this manner, the fully articulated keyboard tray may be arranged at an angle relative to horizontal, and the mouse pad may simultaneously be arranged in a horizontal position.

19 Claims, 12 Drawing Sheets

(56) References Cited

U.S. PATENT DOCUMENTS

| | | | | |
|---|---|---|---|---|
| 6,883,764 | B1 * | 4/2005 | Mileos | A47B 21/0314 108/138 |
| 6,905,102 | B2 | 6/2005 | Lin | |
| 7,004,438 | B2 | 2/2006 | Lin | |
| 7,086,634 | B1 | 8/2006 | Kirchhoff | |
| 7,188,813 | B2 | 3/2007 | Kollar | |
| 7,455,270 | B2 | 11/2008 | Maloney et al. | |
| 7,523,905 | B2 | 4/2009 | Timm et al. | |
| 8,196,884 | B2 | 6/2012 | Chiang | |
| 8,272,600 | B2 | 9/2012 | Copeland et al. | |
| 2007/0012841 | A1 * | 1/2007 | Chen | A47B 21/0314 248/298.1 |
| 2007/0170326 | A1 | 7/2007 | Timm et al. | |
| 2009/0301360 | A1 | 12/2009 | Copeland et al. | |
| 2012/0187056 | A1 * | 7/2012 | Hazzard | A47B 21/02 211/26 |

* cited by examiner

ADJUSTABLE KEYBOARD TRAY AND MOUSE PAD

FIELD OF THE INVENTION

The invention generally relates to a keyboard tray system and, more particularly, to an adjustable keyboard tray with an adjustable mouse pad.

BACKGROUND

A desktop computer normally includes a case, a monitor (e.g., display), a keyboard, and a mouse. The monitor, keyboard, and mouse are communicatively connected to the case via wired or wireless connection (e.g., Bluetooth). In use, a computer's keyboard and mouse are very often placed on (e.g., supported by) a horizontal upper surface of a table or desk. This arrangement functions well, but is not ergonomically efficient. In many situations, the keyboard is too high or low with respect to the user who is seated in a chair. Further, a keyboard placed on a horizontal surface normally causes the user's hands and wrists to be positioned in a non-ideal position that causes strain in the wrist and forearm.

Adjustable keyboard trays that attach to a table or desk have been introduced to provide a degree of adjustability in positioning the keyboard relative to the user. The adjustable keyboard trays are typically connected to the underside of the table or desk and provide for translational motion in a horizontal direction relative to the table or desk. In this manner, the keyboard can be moved between a stowed position underneath the table or desk and an operative (use) position away from the table or desk. Some adjustable keyboard trays also include mechanisms for height adjustment (i.e., vertical motion of the keyboard relative to the table or desk) and angular adjustment (i.e., rotational movement of the keyboard tray about a horizontal axis).

SUMMARY

In an aspect of the invention, there is a keyboard tray system comprising: a keyboard tray; a first connection mechanism connected to the keyboard tray and configured to connect to an object; and a mouse pad adjustably connected to the keyboard tray by a second connection mechanism. The second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray.

In another aspect of the invention, there is a keyboard tray system comprising: a keyboard tray; a first connection mechanism connected to the keyboard tray and configured to connect to an object; and a mouse pad adjustably connected to the keyboard tray by a second connection mechanism. The first connection mechanism is structured and arranged to provide: vertical height adjustment of the keyboard tray relative to the object; horizontal translational adjustment of the keyboard tray relative to the object; swivel movement of the keyboard tray about a vertical axis; and tilt angle adjustment of the keyboard tray about a horizontal axis. The second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray.

The second connection mechanism is selectively connectable to the keyboard tray at a first predefined location and a second predefined location. The angular position adjustment mechanism is structured to permit an upper surface of the mouse pad to be horizontal when the keyboard tray is angled at a negative tilt angle.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention generally relates to a keyboard tray system and, more particularly, to an adjustable keyboard tray with an adjustable mouse pad. According to aspects of the invention, there is a system that includes an adjustable keyboard tray and a mouse pad adjustably attached to the keyboard tray. In embodiments, a connection mechanism of the keyboard tray is configured to connect the keyboard tray to a table, desk, or other object and provide the following adjustments: vertical height movement of the keyboard tray relative to the desk, table, or other object to which it is connected; horizontal translational movement of the keyboard tray relative to the desk, table, or other object to which it is connected; swivel movement of the keyboard tray about a vertical axis; and adjustable typing angle of the keyboard tray relative to a horizontal axis.

According to aspects of the invention, the system includes a mouse pad adjustably connected to the keyboard tray. In embodiments, a connection mechanism of the mouse pad is configured to: permit the mouse pad to be selectively connected to either a left side or a right side of the keyboard tray; provide for angular adjustment of the mouse pad relative to the keyboard tray; and provide for height adjustment of the mouse pad relative to the keyboard tray. Implementations of the invention thus provide for a fully articulated keyboard tray with a separately adjustable mouse pad. In this manner, the keyboard tray may be arranged at an angle relative to horizontal to accommodate an ergonomically preferred position for the user's hands and wrists, and the mouse pad may simultaneously be arranged in a horizontal position to prevent slippage of the mouse off the mouse pad.

Figure 1B:
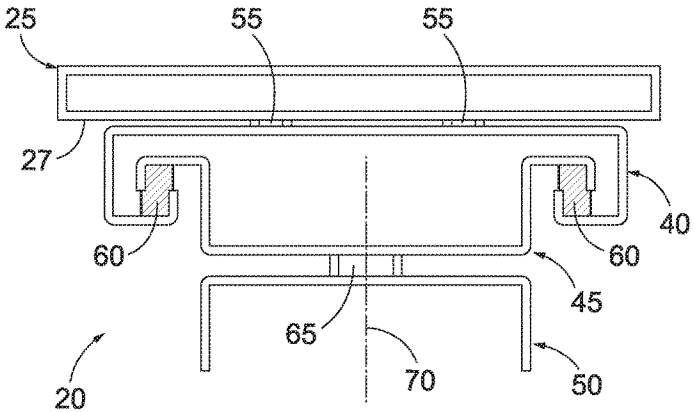
FIGS. 1A-1C and 2-19 show aspects of a first embodiment of a keyboard tray system in accordance with aspects of the invention.
Figure 1A:
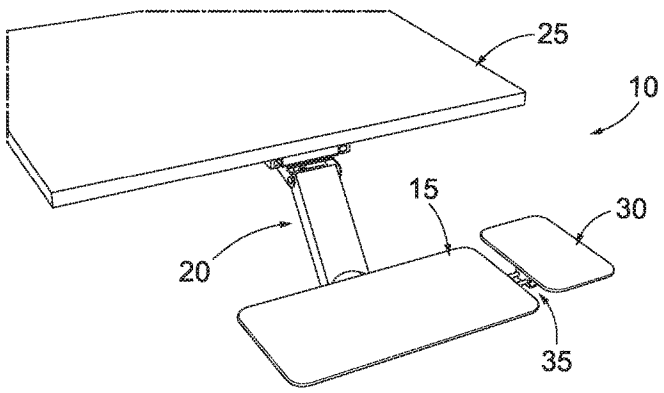

FIGS. 1A-1C and 2-19 show aspects of a first embodiment of a keyboard tray system in accordance with aspects of the invention. FIGS. 1A and 1B show perspective views of the first embodiment of a keyboard tray system 10 that includes: a keyboard tray 15; a first connection mechanism 20 configured to connect the keyboard tray 15 to an object 25; and a mouse pad 30 connected to the keyboard tray 15 by a second connection mechanism 35. The keyboard tray 15 is configured to support a computer keyboard on an upper surface 17 of the keyboard tray 15. The mouse pad 30 is configured to support a computer mouse device on an upper surface 32 of the mouse pad 30. The object 25 may be any suitable object to which a keyboard tray is attached, including but not limited to a desk, a table, or a shelf. Each of the components of the system 10 as described herein may be manufactured using suitable material such as metal, plastic, rubber, wood, engineered wood, and laminate, and combinations of two or more thereof.

In accordance with aspects of the invention, the first connection mechanism 20 provides: vertical height adjustment of the keyboard tray 15 relative to the object 25; horizontal translational adjustment of the keyboard tray 15 relative to the object 25; swivel movement of the keyboard tray 15 about a vertical axis; and adjustable tilt (typing) angle of the keyboard tray 15 relative to a horizontal axis. In accordance with aspects of the invention, the second connection mechanism 35 is configured to: permit the mouse pad 30 to be connected to either a left side or a right side of the keyboard tray 15; provide for angular adjustment of the mouse pad 30 relative to the keyboard tray 15; and provide for height adjustment of the mouse pad 30 relative to the keyboard tray 15.

Figure 1C:
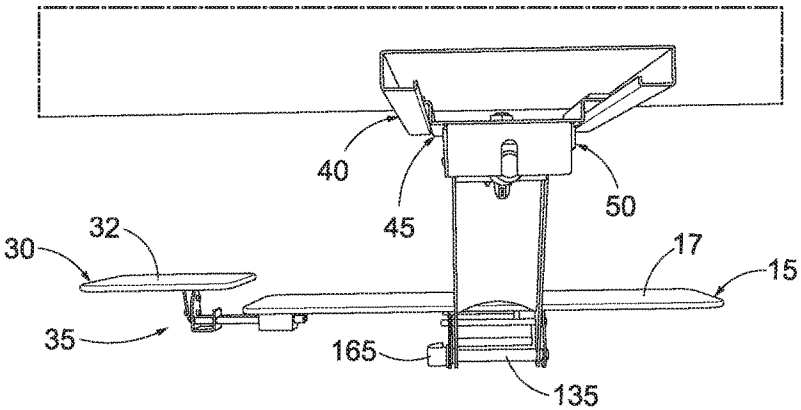

With reference to FIG. 1C, the first connection mechanism 20 is configured to be connected to an underside surface 27 of the object 25. In embodiments, the first connection mechanism 20 includes a rail 40, a truck 45, and a swivel bracket 50. The rail 40 is fixedly connected to the underside 27 of the object 25 using any suitable fastener 55 such as, for example, screw, nail, bolt, staple, adhesive, etc. The truck 45 is moveably connected to the rail 40 in a manner that permits translational movement of the truck 45 relative to the rail 40 in a horizontal plane, e.g., in a plane parallel to the underside surface 27 of the object 25. For example, the rail 40 may include two downwardly depending tracks, the truck 45 may include two upwardly depending hangers, and a bearing 60 may be located between respective pairs of the tracks and the hangers. The bearing 60 may comprise any suitable type of bearing including but not limited to a linear-motion bearing, linear slide, and linear bushing. The arrangement of the rail 40, truck 45 and bearings 60 thus provides for linear translational movement of the truck 45 (and the keyboard tray 15) relative to the rail 40 (and the object 25), e.g., into and out of the plane of the paper as depicted in the diagrammatic view of FIG. 1C.

Still referring to FIG. 1C, the swivel bracket 50 is connected to the truck 45 in a manner that provides swivel movement of the swivel bracket 50 relative to the truck 45. In embodiments, the swivel bracket 50 is connected to the truck 45 by a pin 65 or other suitable mechanism that defines an axis of rotation 70 of the swivel bracket 50 relative to the truck 45. In embodiments, the axis 70 is aligned in a vertical direction and is perpendicular to both the underside surface 27 of the object 25 and the plane of translational movement of the truck 45 relative to the rail 40. The arrangement of the truck 45, swivel bracket 50, and pin 65 thus provides for rotational movement of the swivel bracket 50 (and the keyboard tray 15) relative to the truck 45.

Figure 2:
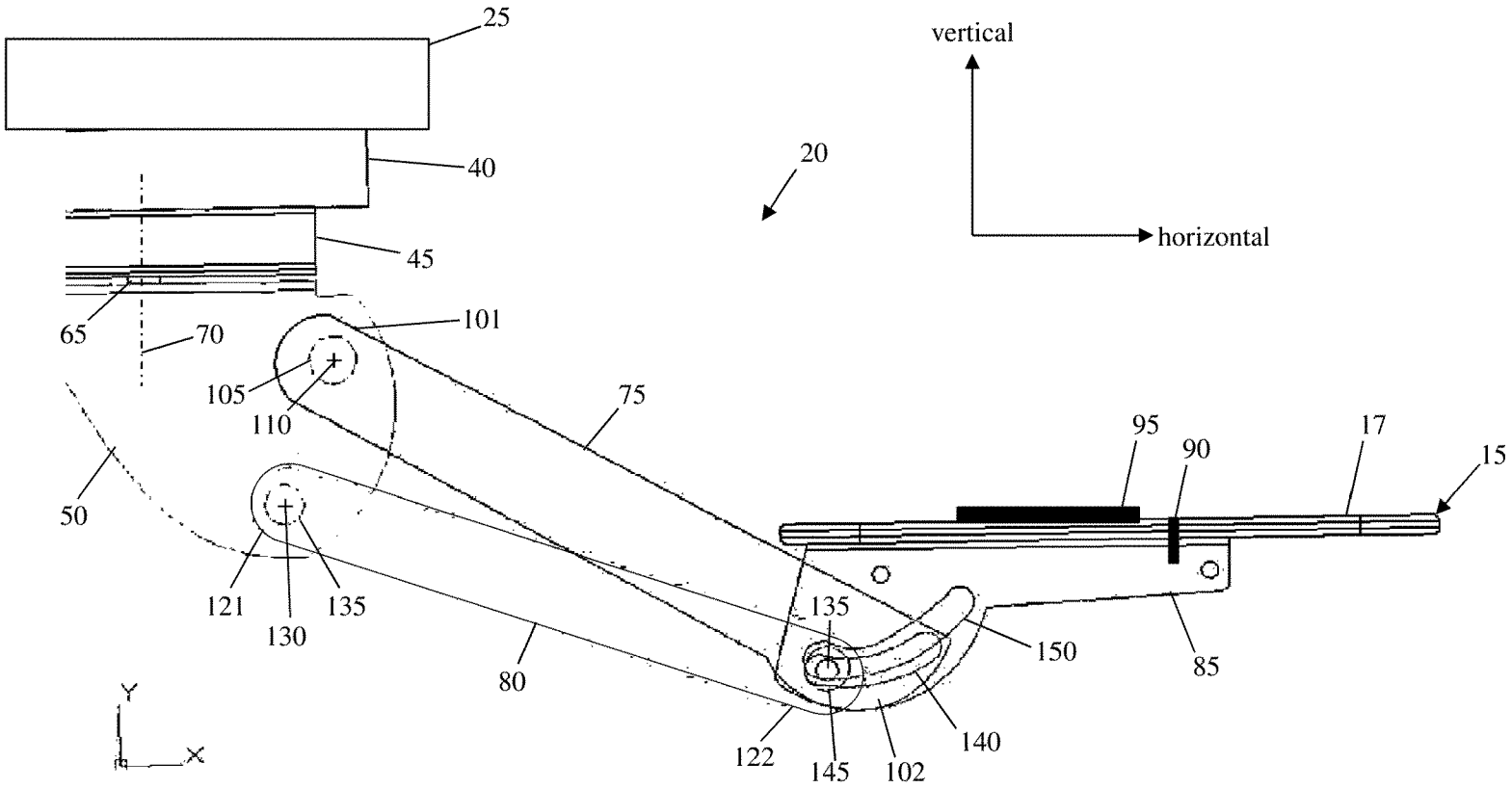
Figure 3:
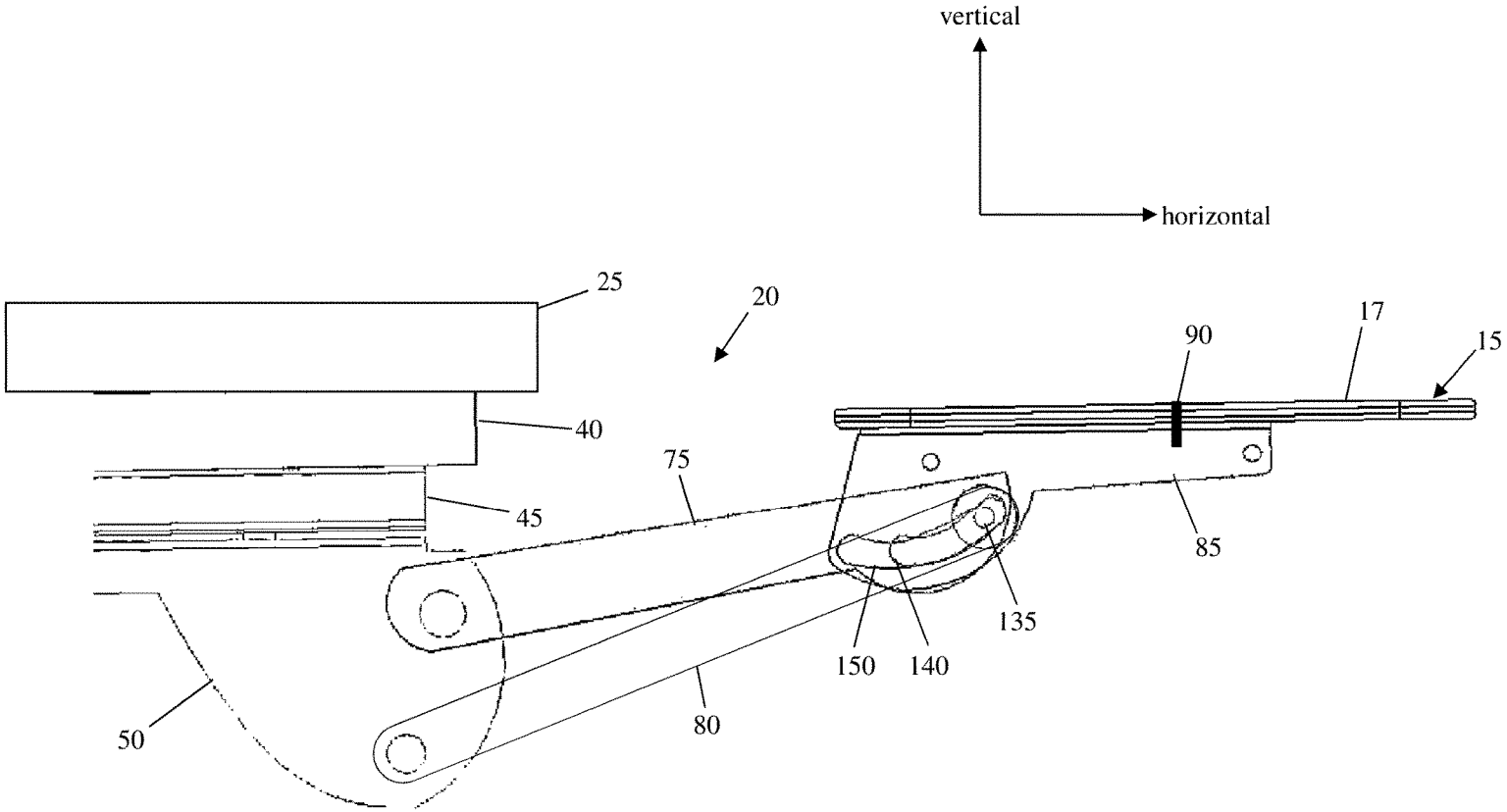

FIGS. 2 and 3 show side views of the first connection mechanism 20 including the rail 40, truck 45, swivel bracket 50, pin 65, and axis 70. In embodiments, the first connection mechanism 20 includes a first arm 75 and a second arm 80 connected between the swivel bracket 50 and a tray bracket 85. The keyboard tray 15 is fixedly connected to the tray bracket 85. In accordance with aspects of the invention, the swivel bracket 50, first arm 75, second arm 80, and tray bracket 85 and structured and arranged to provide a height adjustment mechanism for the keyboard tray 15 to move vertically relative to the rail 40 (and thus the object 25). For example, FIG. 2 shows the keyboard tray 15 at a first vertical position relative to the rail 40, and FIG. 3 shows the keyboard tray 15 at a second vertical position relative to the rail 40, with the second vertical position being higher than the first vertical position.

The keyboard tray 15 is fixedly connected to the tray bracket 85 using any suitable fastener 90 such as, for example, screw, nail, bolt, staple, adhesive, etc. A material 95 having non-skid properties may be affixed (e.g., using adhesive) to the upper surface 17 of the keyboard tray 15 to provide a non-skid surface for a keyboard placed on the upper surface 17 of the keyboard tray 15. Alternatively, the keyboard tray 15 may be constructed of a material that provides a non-skid surface at the upper surface 17 of the keyboard tray 15. In either case, the non-skid material may comprise rubber or plastic that is relatively softer than a material of a keyboard that is placed on the upper surface 17 of the keyboard tray 15.

With continued reference to FIGS. 2 and 3, in a preferred embodiment a proximal end 101 of the first arm 75 is connected to the swivel bracket 50 by a pin 105 that permits the first arm 75 to rotate relative to the swivel bracket 50 and about a first horizontal axis 110. In this embodiment a proximal end 121 of the second arm 80 is connected to the swivel bracket 50 by a pin 125 that permits the second arm 80 to rotate relative to the swivel bracket 50 and about a second horizontal axis 130 that is offset from the first horizontal axis 110.

According to aspects of the invention, a distal end 102 of the first arm 75 and a distal end 122 of the second arm 80 are both connected to the tray bracket 85 by a locking pin 135. In embodiments, the distal end 102 of the first arm 75 includes a first curved slot 140, the distal end 122 of the second arm 80 includes a hole 145, the tray bracket 85 includes a second curved slot 150, and the locking pin 135 passes through each of the first curved slot 140, the hole 145, and the second curved slot 150 in the manner shown in FIGS. 2 and 3. The swivel bracket 50, first arm 75, second arm 80, tray bracket 85, first pin 105, second pin 125, and locking pin 135 arranged in this manner constitute a linkage mechanism that permits vertical movement of the tray bracket 85 relative to the swivel bracket 50, and thus provides a vertical adjustment mechanism of the keyboard tray 15 relative to the rail 40.

In operation, the locking pin 135 moves along a curved path within the curved slots 140 and 150 as the tray bracket 85 is moved vertically relative to the swivel bracket 50. According to aspects of the invention, the curvature of the curved slots 140 and 150 provides a tilt adjustment mechanism for the tray bracket 85 about a horizontal axis. For example, as shown by the dashed lines 15' in FIG. 3, the keyboard tray 15 may be pivoted about a horizontal axis while the first arm 75 and second arm 80 are held stationary at a particular height adjustment position. In this manner, the keyboard tray 15 may be pivoted (e.g., tilted) about a horizontal axis while at different vertical positions relative to the swivel bracket 50.

Figure 17:
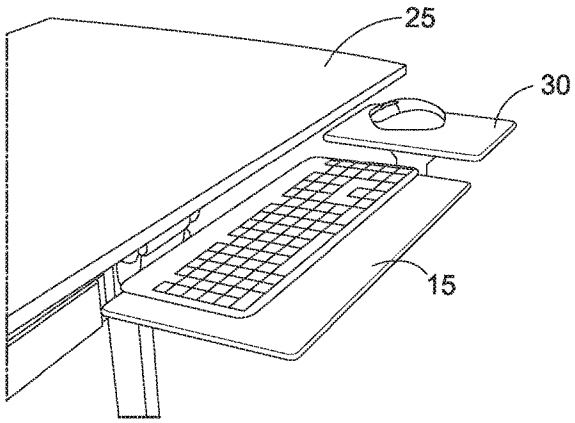
Figure 19:
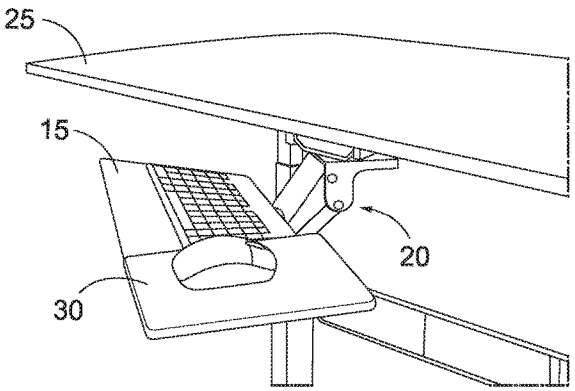
Figure 16:
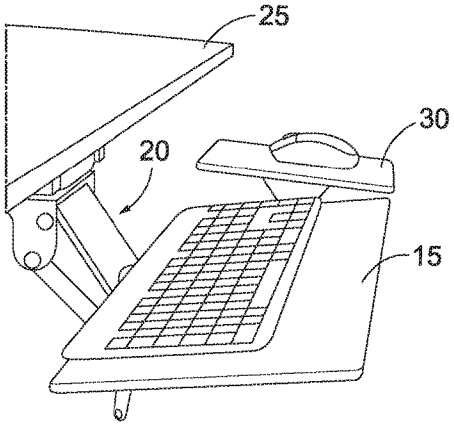
Figure 18:
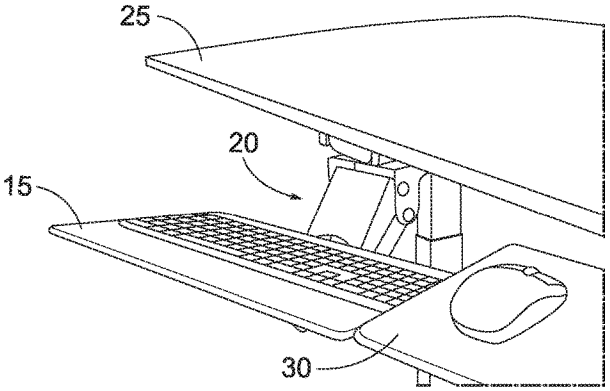

FIG. 3 shows an example of the keyboard tray 15 being pivoted (e.g., tilted) to a negative angle relative to a horizontal plane (also called a negative tilt angle), e.g., with the lower end of the keyboard tray 15 being closer to the rail 40 and the higher end of the keyboard tray 15 being closer to the user. A negative tilt angle of the keyboard tray relative to a horizontal plane is also shown in FIGS. 16, 18, and 19. FIGS. 2, 3, and 17 show the keyboard tray 15 arranged at a zero tilt angle relative to the horizontal plane (i.e., parallel to the horizontal plane). Aspects of the invention also permit the keyboard tray to be pivoted (e.g., tilted) to a positive tilt angle relative to the horizontal plane (also called a positive tilt angle), e.g., with the higher end of the keyboard tray 15 being closer to the rail 40 and the lower end of the keyboard tray 15 being closer to the user.

Figure 5:
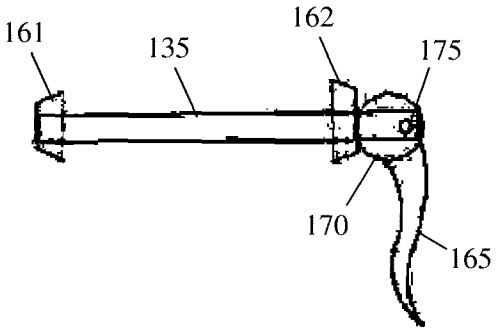
Figure 4:
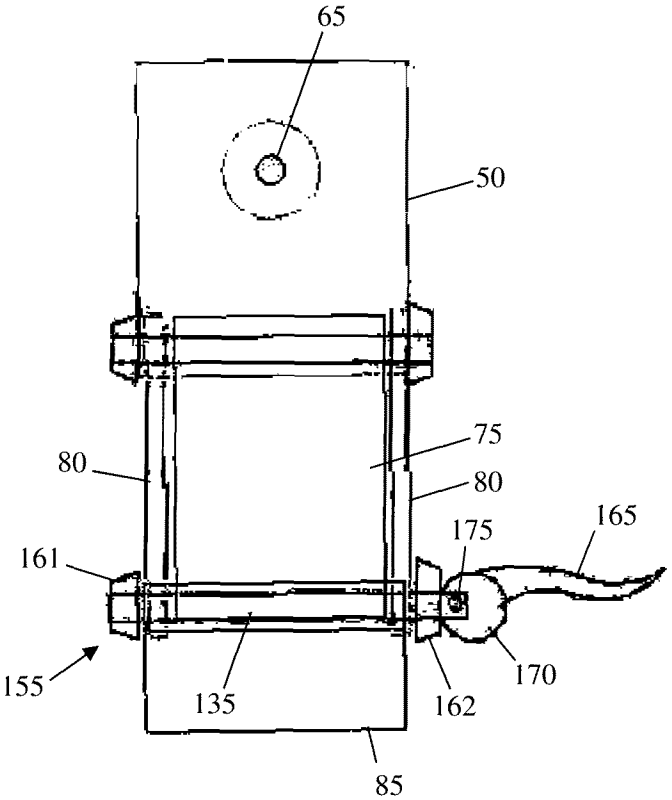

FIGS. 4 and 5 show details of a locking mechanism in accordance with aspects of the invention. In embodiments, the locking pin 135 is part of a locking mechanism 155 that is structured and arranged to lock the tray bracket 85 at a desired vertical position relative to the swivel bracket 50. The locking mechanism 155 is also structured and arranged to lock the tray bracket 85 at a desired tilt angle relative to the horizontal plane (e.g., negative tilt angle, positive tilt angle, or zero tilt angle as described herein). In accordance with aspects of the invention, the single locking mechanism 155 controls both the vertical adjustment of the keyboard tray 15 relative to the swivel bracket 50 and the tilt angle adjustment of the keyboard tray 15 relative to horizontal, as opposed to having two separate locking mechanisms for the two adjustments.

FIG. 4 shows a plan view illustrating the connected relationship between the swivel bracket 50, first arm 75, second arm 80, tray bracket 85, and locking pin 135. In embodiments, the locking mechanism 155 includes the locking pin 135, a first stopper 161 connected to a first end of the locking pin 135, a second stopper 162 near a second end of the locking pin 135, and a lever 165 and cam 170 pivotally connected to the second end of the locking pin 135. The lever 165 and cam 170 can be pivoted relative to the second end of the locking pin 135 between an unlocked position and a locked position. The pivotal connection between the cam 170 and the end of the locking pin 135 may be provided by a pin 175.

In the unlocked position, shown in FIG. 4, a short side of the cam 170 is against the second stopper 162 such that the second stopper 162 is permitted to move away from the tray bracket 85, thereby releasing a tightening force. When the lever 165 and cam 170 are in the unlocked position, the absence of a tightening force permits vertical movement of the tray bracket 85 relative to the swivel bracket 50 and/or pivoting movement of the tray bracket 85 relative to a horizontal plane. In the locked position, shown in FIG. 5, a long side of the cam 170 is against the second stopper 162 such that the second stopper 162 is urged toward the tray bracket 85, thereby applying a tightening force. When the lever 165 and cam 170 are in the locked position, the tightening force inhibits vertical movement of the tray bracket 85 relative to the swivel bracket 50 and inhibits pivoting movement of the tray bracket 85 relative to a horizontal plane. In embodiments, the tightening force of the locking mechanism 155 may be adjusted, for example, by moving the position of the first stopper 161 along the length of the locking pin 135, e.g., by threaded connection.

As shown in FIG. 4, the first arm 75 may comprise a single structural element with two downwardly depending portions, and the second arm 80 may comprise two separate structural elements.

Figure 8:
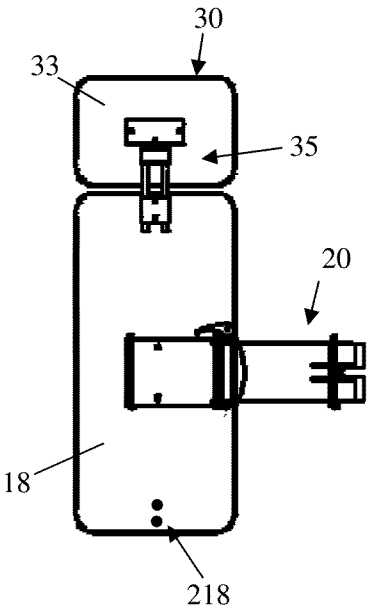
Figure 7:
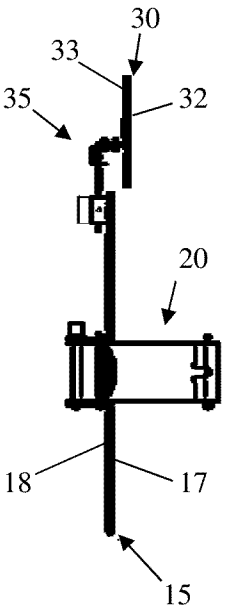
Figure 6:
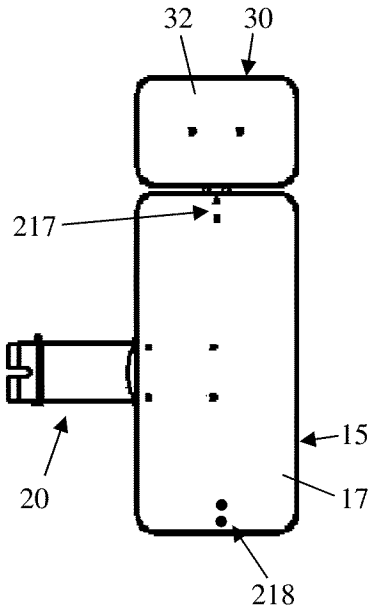

FIGS. 6-15 show aspects of the adjustable mouse pad in accordance with aspects of the invention. FIG. 6 shows a top view, FIG. 7 shows a side view, and FIG. 8 shows a bottom view of the keyboard tray 15, the first connection mechanism 20, the mouse pad 30, and the second connection mechanism 35. In embodiments, as shown in FIG. 8, the first connection mechanism 20 is attached to the bottom surface 18 of the keyboard tray 15, and the second connection mechanism 35 is attached to both the bottom surface 18 of the keyboard tray 15 and the bottom surface 33 of the mouse pad 30.

Figure 11:
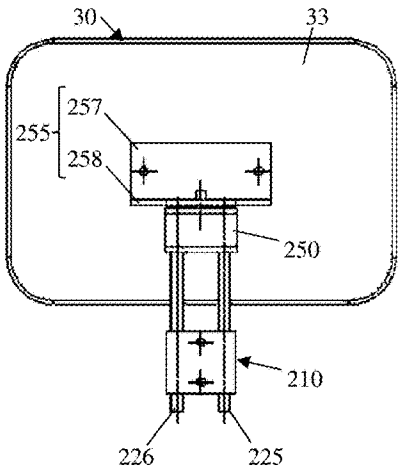
Figure 10A:
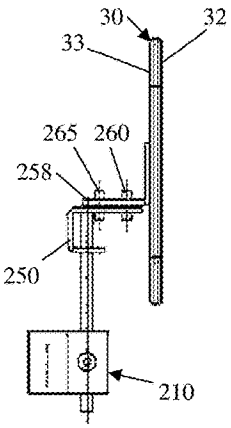
Figure 9:
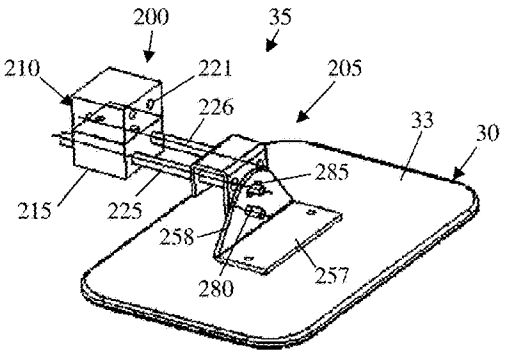

FIGS. 9-11 show aspects of the second connection mechanism 35 in accordance with aspects of the invention. FIG. 9 shows a bottom perspective view, FIGS. 10A, 10B, 10C, 10D, and 10E show side views, and FIG. 11 shows a bottom view of the second connection mechanism 35. In embodiments, the second connection mechanism 35 includes a height adjustment mechanism 200 configured to adjust a vertical height of the mouse pad 30 relative to the keyboard tray 15, and an angular position adjustment mechanism 205 configured to adjust a pivotable position of the mouse pad 30 relative to the keyboard tray 15.

According to aspects of the invention, the height adjustment mechanism 200 is configured to provide at least two, and preferably three, distinct positions for adjusting a height of the top surface 32 of the mouse pad 30 relative to the top surface 17 of the keyboard tray 15. In embodiments, the height adjustment mechanism 200 comprises a block 210 that is connected to the keyboard tray 15 such that a top surface 215 of the block 210 abuts the bottom surface 18 of the keyboard tray 15. The block 210 may be connected to the keyboard tray 15 in any suitable manner including, for example, screw fasteners 220 or the like.

Figure 10B:
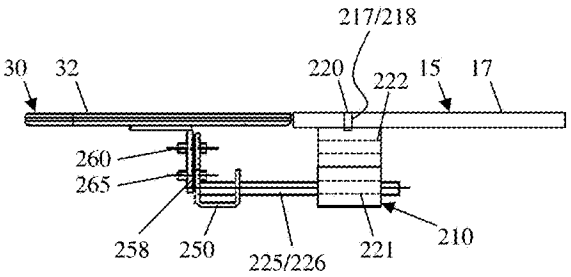
Figure 10C:
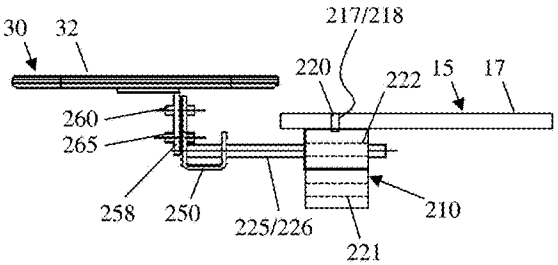

According to aspects of the invention, the second connection mechanism 35 is configured to be connected to the keyboard tray 15 at two different locations. In embodiments, the keyboard tray 15 includes two different sets of mounting holes that are configured to receive the fasteners 220 that secure the block 210 to the keyboard tray 15. For example, as shown in FIGS. 6 and 8, a first set of mounting holes 217 may be positioned in the keyboard tray 15 such that the block 210 may be fastened to a right side of the keyboard tray 15 for users who prefer to operate the mouse device with their right hand, and a second set of mounting holes 218 may be positioned in the keyboard tray 15 such that the block 210 may be fastened to a left side of the keyboard tray 15 for users who prefer to operate the mouse device with their left hand. In a preferred embodiment, a screw fastener 220 travels completely through hole 217 or hole 218 in the keyboard tray 15 and is either captured by a threaded section of the block 210 or passes through the block 210 and is captured by a threaded nut. In this manner, the second connection mechanism 35 is selectively detachable from and re-attachable to the keyboard tray 15 at a first predefined location (e.g., hole 217) and a second predefined location (e.g. hole 218), wherein the second connection mechanism 35 is connected to the keyboard tray 15 by a fastener 220 through the keyboard tray at one of the first predefined location and the second predefined location The block 210 includes at least two position settings which, in embodiments, comprise two sets of holes 221, 222 that are configured to receive bars 225, 226 that are fixedly connected to the angular position adjustment mechanism 205. In embodiments, the holes 221, 222 are structured and arranged to receive and retain ends of the bars 225, 266. The first holes 221 are vertically offset from the second holes 222 such that the mouse pad 30 can be placed in a first vertical position when the bars 225, 226 are placed in the first holes 221 (FIG. 10B), and the mouse pad 30 can be placed in a second vertical position when the bars 225, 226 are placed in the second holes 222 (FIG. 10C). The inside diameter of the holes 221, 222 may be sized relative to the outside diameter of the bars 225, 226 such that the bars 225, 226 are retained in the holes by friction that can be overcome by a user. Additionally or alternatively, a detent, thumb screw, or other retaining mechanism may be used to retain the bars 225, 226 in the holes 221, 222 in a manner that prevents the bars 225, 226 from falling out of the holes due to gravity but that permits a user to apply a force to extract the bars 225, 226 from the holes. The height adjustment mechanism 200 is not limited to using two bars 225, 226, two first holes 221, and two second holes 222, but rather any suitable number of bars and corresponding number of first holes and second holes may be used. For example, a single bar may be used with a single first hole and a single second hole.

Figure 10E:
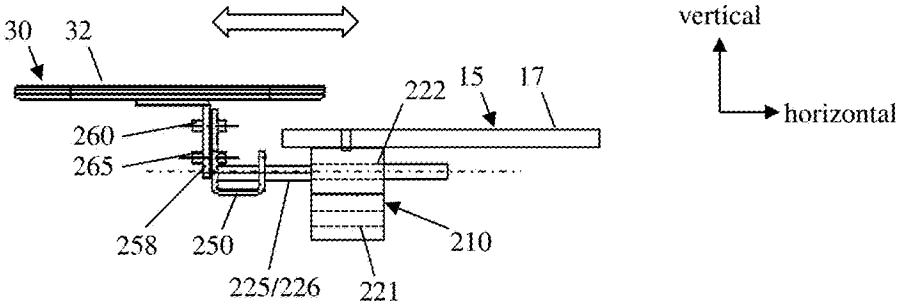
Figure 10D:
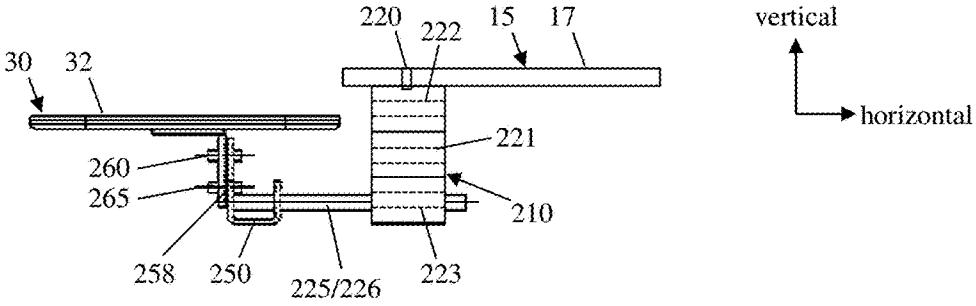

In a preferred embodiment, the block 210 includes at least three sets of holes, with each respective set of holes corresponding to a respective height of the mouse pad 30 relative to the keyboard tray 15. Specifically, the three sets of holes may include: first holes 221 that permit the mouse pad 30 to be set at the same level as keyboard tray 15 (FIG. 10B); second holes 222 that permit the mouse pad 30 to be set at the higher level than the keyboard tray 15 (FIG. 10C); and third holes 223 that permit the mouse pad 30 to be set at the lower level than the keyboard tray 15 (FIG. 10D).

According to aspects of the invention, the second connection mechanism 35 is configured to provide horizontal translational adjustment of the mouse pad 30 relative to the keyboard tray 15. As shown in FIG. 10E, the bars 225/226 may be slid further into holes 22 to permit the user to move the mouse pad 30 in a lateral manner relative to the keyboard tray. In this manner, the block 210 constitutes a structural element that is configured to provide both vertical adjustment and horizontal adjustment of the mouse pad 30 relative to the keyboard tray 15.

According to aspects of the invention, the angular position adjustment mechanism 205 is structured and arranged to permit pivotal (tilt) motion of the mouse pad 30 relative to the keyboard tray 15 about an axis that is parallel to the bottom surface 18 of the keyboard tray 15. In embodiments, the angular position adjustment mechanism 205 includes a fixed bracket 250 that is fixedly connected to the bars 225, 226, and a mouse pad bracket 255 that is pivotally connected to the fixed bracket 250. The mouse pad bracket 255 includes a first leg 257 that is fixedly connected to the bottom surface 33 of the mouse pad 30, e.g., by screws, adhesive, etc., and a second leg 258 that depends downward in a direction away from the bottom surface 33 of the mouse pad 30. In a preferred embodiment, the first leg 257 of the mouse pad bracket 255 fits flat against the bottom surface 33 of the mouse pad 30, and the second leg 258 of the mouse pad bracket 255 is substantially orthogonal to the first leg 257.

Referring to FIGS. 9, 10A-C, and 11-15, in accordance with aspects of the invention, a first pin 260 and a second pin 265 are fixedly connected to the fixed bracket 250. The second leg 258 of the mouse pad bracket 255 includes a hole 280 through which the first pin 260 passes and a curved slot 285 through which the second pin 265 passes. In embodiments, the hole 280 is circular and has an interior diameter only slightly larger than the outside diameter of the first pin 260, such that the first pin 260 can rotate within the hole 280 but essentially cannot translate in any radial direction of the hole 280. The hole 280 and the first pin 265 define an axis of rotation of the mouse pad 30 relative to the keyboard tray 15.

The curved slot 285 in the mouse pad bracket 255 receives the second pin 265 that is fixedly attached to the fixed bracket 250. In embodiments, the curved slot 285 has a width only slightly larger than the outside diameter of the second pin 265, and a length much larger than the outside diameter of the second pin 265. Specifically, the curved slot 285 defines a curved path along its length, and the second pin 265 can move relative to the mouse pad bracket 255 along this curved path. In this manner, the first pin 260 and the second pin 265 may be held in a fixed position by the fixed bracket 250, and the mouse pad bracket 255 may be rotated about the axis of rotation defined by the first pin 260 and the hole 280. The extent of the rotation of the mouse pad bracket 255 relative to the fixed bracket 250 (and thus the mouse pad 30 relative to the keyboard tray 15) is defined by the length of the curved slot 285.

Figure 13:
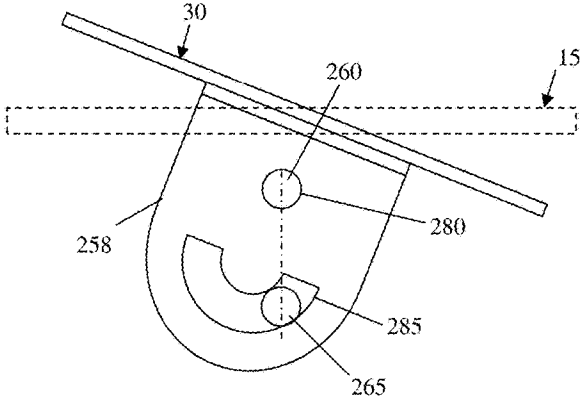
Figure 15:
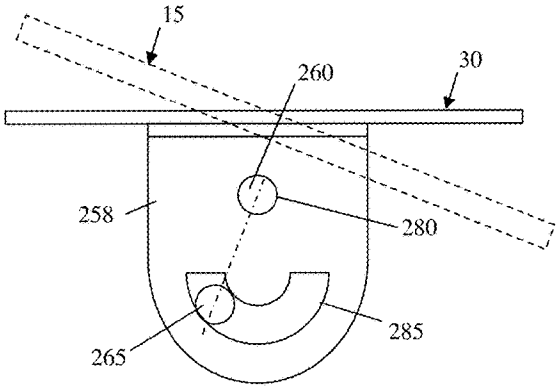
Figure 12:
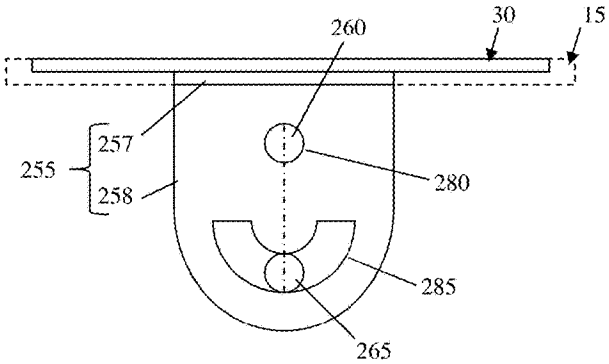
Figure 14:
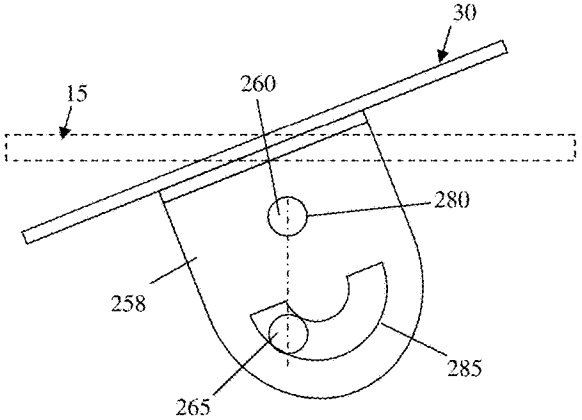

FIGS. 12-15 depict the pivotal motion of the mouse pad 30 relative to the keyboard tray 15 as provided by the mouse pad bracket 255, hole 280, curved slot 285, first pin 260, and second pin 265 of the angular position adjustment mechanism 205. FIG. 12 shows the mouse pad 30 and the keyboard tray 15 both in a horizontal position. FIG. 13 shows the mouse pad 30 pivoted at a negative angle relative to horizontal, and the keyboard tray 15 at a zero angle relative to horizontal. FIG. 14 shows the mouse pad 30 pivoted at a positive angle relative to horizontal, and the keyboard tray 15 at a zero angle relative to horizontal. FIG. 15 shows the mouse pad 30 at a zero angle relative to horizontal, and the keyboard tray 15 at a negative angle relative to horizontal.

In embodiments, the size and shape of the curved slot 285 in the mouse pad bracket 255 is configured to define a range of angular motion of the mouse pad 30 relative to the keyboard tray 15 that is equal to or greater than the range of angular motion of the keyboard tray 15 relative to horizontal. In this manner, for any given position of the keyboard tray 15 relative to horizontal, the mouse pad 30 may be placed in a horizontal position, e.g., as shown in FIG. 15. This provides the benefit of keeping a horizontal surface on which the mouse rests, such that the mouse does not slide off the mouse pad 30 due to gravity, which could happen if the mouse pad 30 were inclined relative to horizontal. In a preferred embodiment, the keyboard tray 15 may be pivoted to a −15° tilt angle relative to horizontal, and the size and shape of the curved slot 285 in the mouse pad bracket 255 is configured such that the mouse pad 30 can pivot at least 15° relative to the keyboard tray 15, such that the upper surface 32 of the mouse pad 30 is horizontal when the keyboard tray 15 is pivoted at the −15° tilt angle relative to horizontal, e.g., as shown in FIG. 15. The invention is not limited to a +/−15° tilt angle of the keyboard tray 15, and other angles may be used. For example, and without limitation, the components of the system 10 may be structured and arranged to provide up to a +/−20° tilt angle or up to a +/−25° tilt angle.

In accordance with a preferred embodiment, the height adjustment mechanism 200 and the angular position adjustment mechanism 205 are two separate mechanisms that can be independently manipulated to perform separate adjustments of the mouse pad 30 relative to the keyboard tray 15. For example, the height of the mouse pad 30 relative to the keyboard tray 15 may be adjusted using the height adjustment mechanism 200 without affecting the tilt of the mouse pad 30 relative to the keyboard tray 15. Conversely, the tilt of the mouse pad 30 relative to the keyboard tray 15 may be adjusted using the angular position adjustment mechanism 205 without affecting the height of the mouse pad 30 relative to the keyboard tray 15. Moreover, the block 210 employed in the height adjustment mechanism 200 additionally permits horizontal translational adjustment of the mouse pad 30 relative to the keyboard tray 15. In this manner, implementations of the invention advantageously provide for separate adjustment mechanisms to facilitate user adjustment of the system.

Figure 20A:
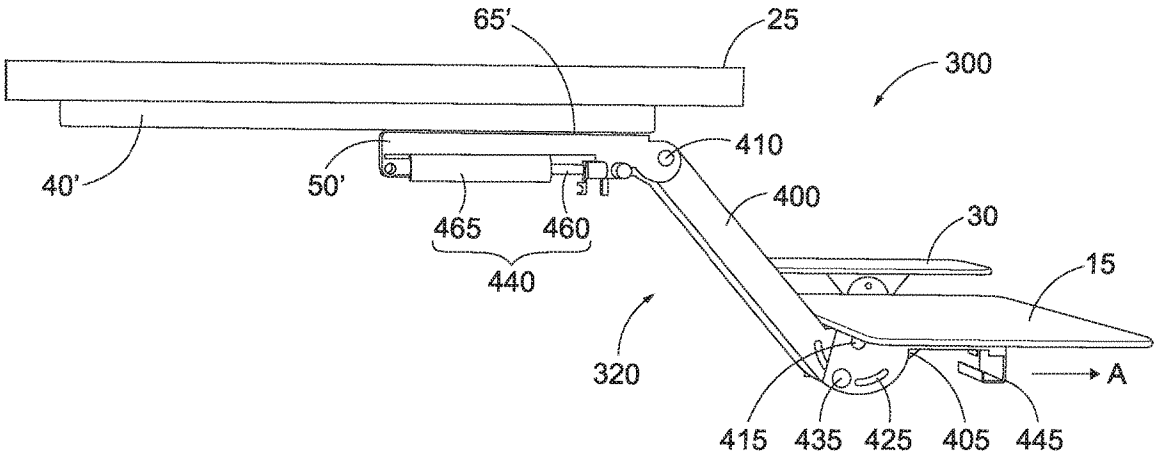
FIGS. 20A-20C and 21-25 show aspects of a second embodiment of a keyboard tray system in accordance with aspects of the invention.
Figure 20B:
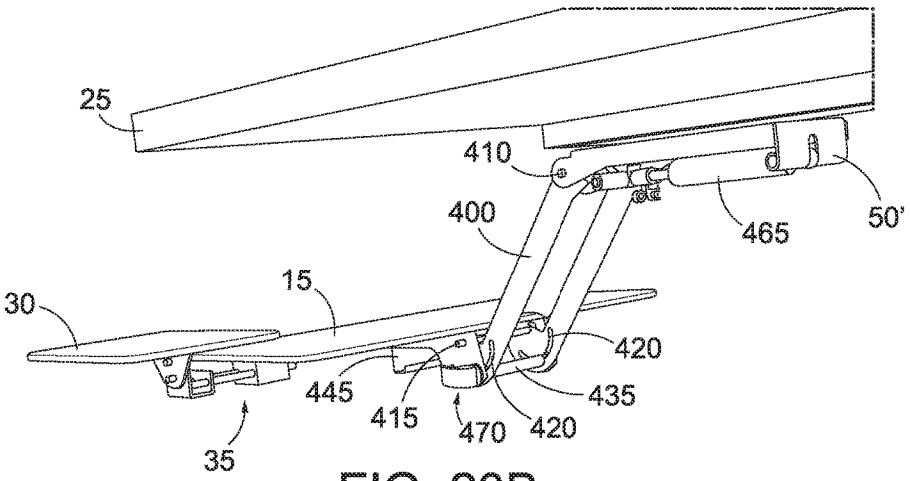
Figure 20C:
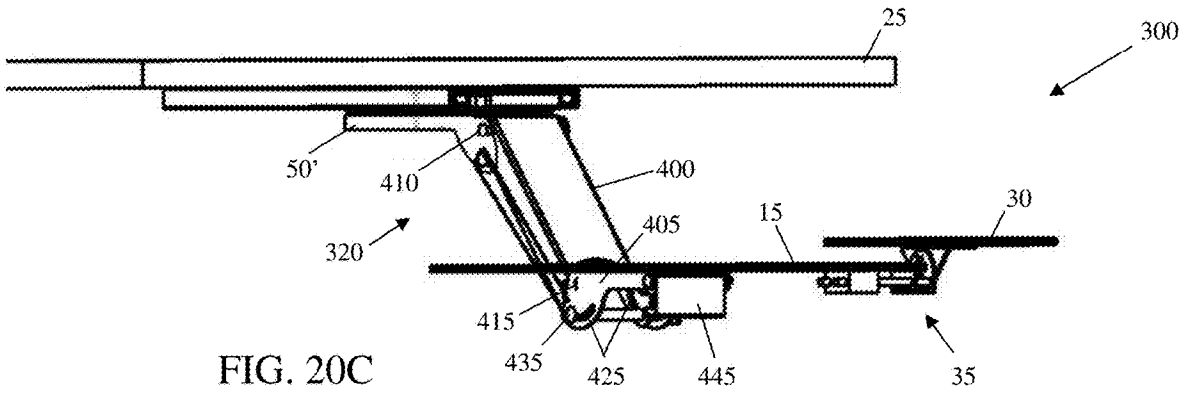

FIGS. 20A-20C and 21-25 show aspects of a second embodiment of a keyboard tray system in accordance with aspects of the invention. FIGS. 20A, 20B, and 20C show perspective views of the second embodiment of a keyboard tray system 300 that includes: a keyboard tray 15; a first connection mechanism 320 configured to connect the keyboard tray 15 to an object 25; and a mouse pad 30 connected to the keyboard tray 15 by a second connection mechanism 35. In the keyboard tray system 300, the keyboard tray 15, mouse pad 30, and second connection mechanism 35 are the same as those elements in keyboard tray system 10 as described with respect to FIGS. 1A-1C and 2-19.

In accordance with aspects of the invention, the first connection mechanism 320 provides: vertical height adjustment of the keyboard tray 15 relative to the object 25; horizontal translational adjustment of the keyboard tray 15 relative to the object 25; swivel movement of the keyboard tray 15 about a vertical axis; and adjustable tilt (typing) angle of the keyboard tray 15 relative to a horizontal axis. In accordance with aspects of the invention, the second connection mechanism 35 is configured to: permit the mouse pad 30 to be connected to either a left side or a right side of the keyboard tray 15; provide for angular adjustment of the mouse pad 30 relative to the keyboard tray 15; and provide for height adjustment of the mouse pad 30 relative to the keyboard tray 15.

In embodiments, the first connection mechanism 320 of the system 300 includes a rail 40' and truck 45' which may configured to operate in a same manner as like-numbered elements of system 10. In this manner, the first connection mechanism 320 of the system 300 provides for translational adjustment of the keyboard tray 15 relative to the rail 40' (and thus the object 25) in the same manner as the system 10.

In embodiments, the first connection mechanism 320 includes a swivel bracket 50' connected to the truck 45' by a pin 65' in the similar manner as swivel bracket 50, truck 45, and pin 65 of the system 10. In this manner, the first connection mechanism 320 of the system 300 provides for rotational adjustment of the keyboard tray 15 relative to the rail 40' (and thus the object 25) in the same manner as the system 10.

According to aspects of the invention, the first connection mechanism 320 includes a height adjustment mechanism of the keyboard tray 15 relative to the rail 40' that is controlled by a first actuator, and a tilt angle adjustment of the keyboard tray 15 relative to a horizontal axis that is controlled by a second actuator different from the first actuator. This is different from the system 10 in which the height adjustment and tilt angle adjustment of the keyboard tray 15 are both controlled by a single actuator, i.e., the locking mechanism 155.

The first connection mechanism 320 includes an arm 400 that is pivotally connected between the swivel bracket 50' and a tray bracket 405. In embodiments, a proximal end of the arm 400 is pivotally connected to the swivel bracket 50' by a pin 410 that defines a horizontal axis of rotation of the arm 400 relative to the swivel bracket 50'. The pin 410 passes through a hole in the arm 400 and a hole in the swivel bracket 50'. A distal end of the arm 400 is pivotally connected to the tray bracket 405 by a pin 415 that defines a horizontal axis of rotation of the arm 400 relative to the tray bracket 405. The pin 415 passes through a hole in the arm 400 and a hole in the tray bracket 405. The distal end of the arm 400 has a first curved slot 420 and the tray bracket 405 has a second curved slot 425. A locking pin 435 passes through the first curved slot 420 and the second curved slot 425.

A cylinder and piston assembly 440 (e.g., a gas spring) has a first end pivotally connected to the swivel bracket 50' and a second end pivotally connected to the proximal end of the arm 400 at a pivot location that is offset from the pin 410 that defines the axis of rotation of the arm 400 relative to the swivel bracket 50'. An actuator 445 (e.g., a finger trigger) is pivotally connected to the tray bracket 405. As shown in FIG. 21-25, a first end of a cable 450 is connected to the cylinder and piston assembly 440 and a second end of the cable 450 is connected to the actuator 445 and a cable stay 455 that is fixedly attached to the tray bracket 405. When the actuator 445 is pulled toward the user as indicated by arrow "A" the cable 450 is pulled and unlocks the piston 460 relative to the cylinder 465, such that the piston 460 can move into and out of the cylinder 465, such that the height of the keyboard tray 15 is adjustable relative to the swivel bracket 50'. The cylinder and piston assembly 440 is configured to urge a force against arm 400 that pushes the keyboard tray 15 toward a higher position. In this manner, when the user pulls the actuator 445, the cylinder and piston assembly 440 assists in pushing the keyboard tray 15 upward. When the user releases the actuator 445, the resulting action of the cable 450 locks the piston 460 relative to the cylinder 465, such that the piston 460 cannot move into and out of the cylinder 465, such that the height of the keyboard tray 15 is locked (i.e., not adjustable) relative to the swivel bracket 50'.

Figure 22:
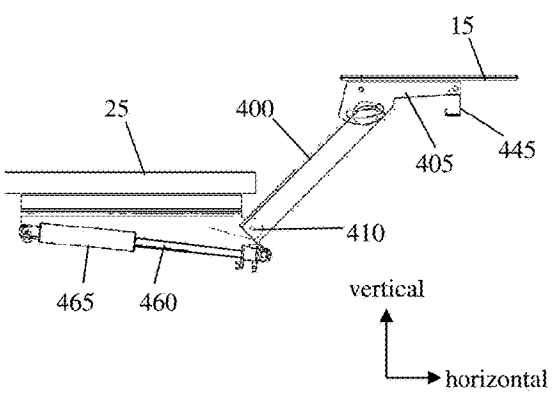
Figure 21:
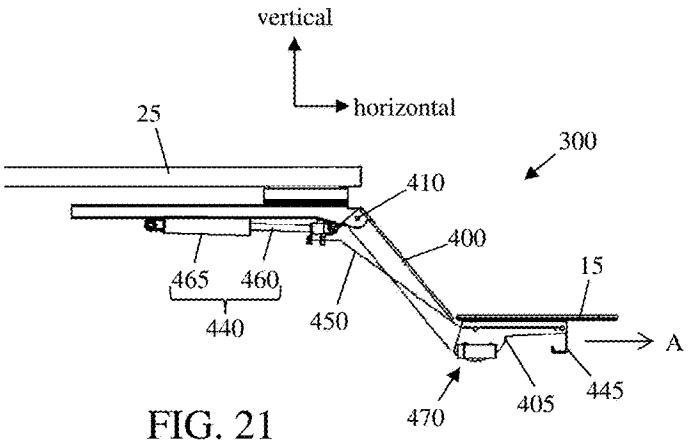
Figure 23:
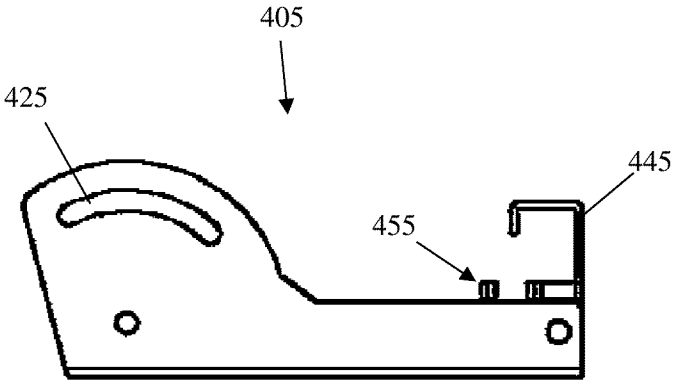
Figure 24:
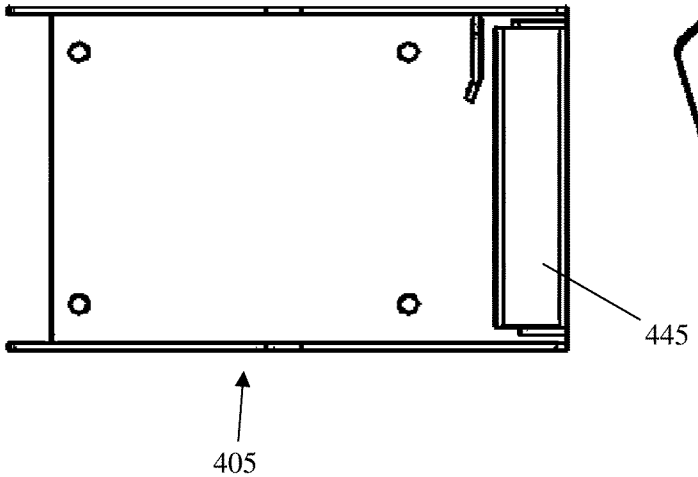
Figure 25:
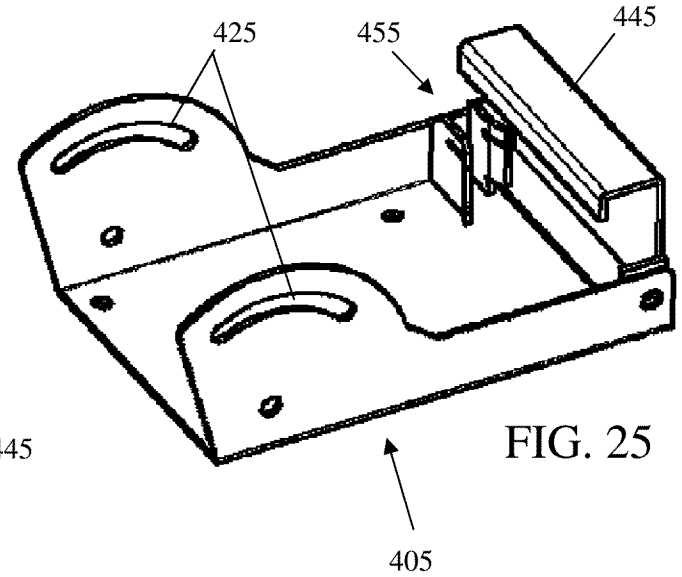

FIG. 21 shows the system 300 with the keyboard tray 15 in a lowered position, and FIG. 22 shows the system with the keyboard tray 15 in a raised position. In a preferred embodiment, the system 300 is structured and arranged to permit the keyboard tray 15 to be up to ten inches lower than the object 25 (e.g., FIG. 21) and up to ten inches higher than the object 25 (e.g., FIG. 22).

In accordance with aspects of the invention, the first connection mechanism 320 provides for a tilt angle adjustment of the keyboard tray 15 relative to a horizontal plane. A locking mechanism 470 includes the locking pin 435 that passes through the first curved slot 420 and the second curved slot 425. The locking mechanism 470 may include stoppers, a cam, and a lever similar to the locking mechanism 155 of the system 10. Similar to the locking mechanism 155, the locking mechanism 470 may be unlocked to permit tilt adjustment of the keyboard tray 15, and may be locked to prevent tilt angle adjustment of the keyboard tray 15.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects.

Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A keyboard tray system, comprising:

a keyboard tray;

a first connection mechanism connected to the keyboard tray and configured to connect to an object; and a mouse pad adjustably connected to the keyboard tray by a second connection mechanism, wherein the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray, wherein the second connection mechanism is selectively detachable from and re-attachable to the keyboard tray at a first predefined location and a second predefined location; and the angular position adjustment mechanism comprises:

a first pin that defines an axis of rotation of the mouse pad relative to the keyboard tray; and a second pin in a curved groove that defines an extent of pivotal motion of the mouse pad relative to the keyboard tray.

2. The system of claim 1, wherein the second connection mechanism is connected to the keyboard tray by a fastener through the keyboard tray at one of the first predefined location and the second predefined location.

3. The system of claim 2, wherein:

connecting the second connection mechanism at the first predefined location causes the mouse pad to be at a right side of the keyboard tray; and connecting the second connection mechanism at the second predefined location causes the mouse pad to be at a left side of the keyboard tray opposite the right side of the keyboard tray.

4. The system of claim 1, wherein the height adjustment mechanism comprises:

a first position in which the mouse pad is at substantially a same height as the keyboard tray; and a second position in which the mouse pad is vertically higher than the keyboard tray.

5. The system of claim 1, wherein the first connection mechanism is structured and arranged to provide:

vertical height adjustment of the keyboard tray relative to the object to which the first connection mechanism is attached;

horizontal translational adjustment of the keyboard tray relative to the object to which the first connection mechanism is attached;

swivel movement of the keyboard tray about a vertical axis; and tilt angle adjustment of the keyboard tray about a horizontal axis.

6. The system of claim 5, wherein:

the tilt angle adjustment of the keyboard tray is structured to provide a fifteen degree negative tilt angle of the keyboard tray relative to horizontal; and the angular position adjustment mechanism is structured to permit the upper surface of the mouse pad to be horizontal when the keyboard tray is angled at the fifteen degree negative tilt angle.

7. The system of claim 5, wherein a single actuator controls locking and unlocking of both the vertical height adjustment of the keyboard tray and the tilt angle adjustment of the keyboard tray.

8. The system of claim 5, wherein:

a first actuator controls locking and unlocking of the vertical height adjustment of the keyboard tray; and a second actuator controls locking and unlocking of the tilt angle adjustment of the keyboard tray, the second actuator being different than the first actuator.

9. The system of claim 8, wherein:

the first actuator comprises a trigger pivotally connected to a bracket that is connected to the keyboard tray; and the second actuator is a locking mechanism that includes: a locking pin; a cam pivotally attached to one end of the locking pin; and a lever connected to the cam.

10. The system of claim 9, further comprising a cable having a first end connected to the trigger and a second end connected to a cylinder and piston assembly, wherein pulling the trigger causes the cable to unlock the piston relative to the cylinder.

11. A keyboard tray system, comprising:

a keyboard tray;

a first connection mechanism connected to the keyboard tray and configured to connect to an object; and a mouse pad adjustably connected to the keyboard tray by a second connection mechanism, wherein the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray, wherein the second connection mechanism is selectively detachable from and re-attachable to the keyboard tray at a first predefined location and a second predefined location; and the height adjustment mechanism comprises:

a first position in which the mouse pad is at substantially a same height as the keyboard tray;

a second position in which the mouse pad is vertically higher than the keyboard tray;

a block connected to a bottom surface of the keyboard tray;

a first set of holes in the block corresponding to the first position;

a second set of holes in the block corresponding to the second position; and bars connected to the mouse pad that are selectively insertable into one of the first set of holes and the second set of holes.

12. A keyboard tray system, comprising:

a keyboard tray;

a first connection mechanism connected to the keyboard tray and configured to connect to an object; and a mouse pad adjustably connected to the keyboard tray by a second connection mechanism, wherein the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray, wherein the second connection mechanism is selectively detachable from and re-attachable to the keyboard tray at a first predefined location and a second predefined location;

the first connection mechanism is structured and arranged to provide:

vertical height adjustment of the keyboard tray relative to the object to which the first connection mechanism is attached;

horizontal translational adjustment of the keyboard tray relative to the object to which the first connection mechanism is attached;

swivel movement of the keyboard tray about a vertical axis; and tilt angle adjustment of the keyboard tray about a horizontal axis;

the tilt angle adjustment of the keyboard tray about the horizontal axis has a maximum tilt angle of the keyboard tray relative to horizontal; and the angular position adjustment mechanism has a maximum tilt angle of the mouse pad relative to the keyboard tray that is equal to or greater than the maximum tilt angle of the keyboard tray relative to horizontal.

13. A keyboard tray system, comprising:

a keyboard tray;

a first connection mechanism connected to the keyboard tray and configured to connect to an object; and a mouse pad adjustably connected to the keyboard tray by a second connection mechanism, wherein the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray, wherein the second connection mechanism is selectively detachable from and re-attachable to the keyboard tray at a first predefined location and a second predefined location;

the first connection mechanism is structured and arranged to provide:

vertical height adjustment of the keyboard tray relative to the object to which the first connection mechanism is attached;

horizontal translational adjustment of the keyboard tray relative to the object to which the first connection mechanism is attached;

swivel movement of the keyboard tray about a vertical axis; and tilt angle adjustment of the keyboard tray about a horizontal axis;

a single actuator controls locking and unlocking of both the vertical height adjustment of the keyboard tray and the tilt angle adjustment of the keyboard tray; and the single actuator is a locking mechanism that includes: a locking pin; a cam pivotally attached to one end of the locking pin; and a lever connected to the cam.

14. A keyboard tray system, comprising:

a keyboard tray;

a first connection mechanism connected to the keyboard tray and configured to connect to an object;

a mouse pad adjustably connected to the keyboard tray by a second connection mechanism, wherein the first connection mechanism is structured and arranged to provide: vertical height adjustment of the keyboard tray relative to the object; horizontal translational adjustment of the keyboard tray relative to the object; swivel movement of the keyboard tray about a vertical axis; and tilt angle adjustment of the keyboard tray about a horizontal axis;

the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray;

the second connection mechanism is selectively detachable from and re-attachable to the keyboard tray at a first predefined location and a second predefined location;

the second connection mechanism is configured to provide horizontal translational adjustment of the mouse pad relative to the keyboard tray; and the angular position adjustment mechanism is structured to permit an upper surface of the mouse pad to be horizontal when the keyboard tray is angled at a negative tilt angle;

a first actuator controls locking and unlocking of the vertical height adjustment of the keyboard tray;

a second actuator controls locking and unlocking of the tilt angle adjustment of the keyboard tray, the second actuator being different than the first actuator;

the first actuator comprises a trigger pivotally connected to a bracket that is connected to the keyboard tray, wherein a first end of a cable is connected to the trigger and a second end of the cable is connected to a cylinder and piston assembly; and the second actuator is a locking mechanism that includes: a locking pin; a cam pivotally attached to one end of the locking pin; and a lever connected to the cam.

15. The system of claim 14, wherein:

the tilt angle adjustment of the keyboard tray about the horizontal axis has a maximum tilt angle of the keyboard tray relative to horizontal; and the angular position adjustment mechanism has a maximum tilt angle of the mouse pad relative to the keyboard tray that is equal to or greater than the maximum tilt angle of the keyboard tray relative to horizontal.

16. The system of claim 14, wherein the height adjustment mechanism comprises:

a block connected to a bottom surface of the keyboard tray;

a bar connected to the mouse pad that is selectively insertable into one of a first hole, a second hole, and a third hole in the block;

the first hole corresponds to a first position at which the mouse pad is at substantially a same height as the keyboard tray;

the second hole corresponds to a second position at which the mouse pad is vertically higher than the keyboard tray; and the third hole corresponds to a third position at which the mouse pad is vertically lower than the keyboard tray.

17. The system of claim 14, wherein the angular position adjustment mechanism comprises:

a first pin that defines an axis of rotation of the mouse pad relative to the keyboard tray; and a second pin in a curved groove that defines an extent of pivotal motion of the mouse pad relative to the keyboard tray.

18. A keyboard tray system, comprising:

a keyboard tray;

a first connection mechanism connected to the keyboard tray and configured to connect to an object; and a mouse pad adjustably connected to the keyboard tray by a second connection mechanism, wherein the second connection mechanism comprises: a height adjustment mechanism configured to adjust a vertical height of the mouse pad relative to the keyboard tray; and an angular position adjustment mechanism configured to adjust a pivotal position of the mouse pad relative to the keyboard tray, wherein the second connection mechanism is selectively detachable from and re-attachable to the keyboard tray at a first predefined location and a second predefined location; and the height adjustment mechanism comprises:

a first position in which the mouse pad is at substantially a same height as the keyboard tray;

a second position in which the mouse pad is vertically higher or vertically lower than the keyboard tray;

a block connected to a bottom surface of the keyboard tray;

at least one first hole in the block corresponding to the first position;

at least one second hole in the block corresponding to the second position; and at least one bar connected to the mouse pad that is selectively insertable into one of the at least one first hole and the at least one second hole.

19. The system of claim 18, wherein the angular position adjustment mechanism comprises:

a first pin that defines an axis of rotation of the mouse pad relative to the keyboard tray; and a second pin in a curved groove that defines an extent of pivotal motion of the mouse pad relative to the keyboard tray.

* * * * *